US005980142A

United States Patent [19]

Inui

[11] Patent Number: 5,980,142

[45] Date of Patent: Nov. 9, 1999

[54] THERMAL PRINTER WITH JAM DETECTION DEVICE

[75] Inventor: Fuyuki Inui, Saitama, Japan

[73] Assignee: Fuji Photo Film Co., Ltd., Kanagawa, Japan

[21] Appl. No.: 08/738,272

[22] Filed: Oct. 25, 1996

[30] Foreign Application Priority Data

Oct. 27, 1995 [JP] Japan ..... 7-280711

[51] Int. Cl.[6] ..... B41J 29/387

[52] U.S. Cl. ..... 400/708; 400/74

[58] Field of Search ..... 400/54, 74, 708, 400/120.02, 120.03, 120.04

[56] References Cited

U.S. PATENT DOCUMENTS

| | | | |
|---|---|---|---|
| 4,590,859 | 5/1986 | Pou et al. | 400/582 |
| 4,880,324 | 11/1989 | Sato | 400/120.03 |
| 5,061,947 | 10/1991 | Morrison et al. | 400/618 |
| 5,086,987 | 2/1992 | Sheih | 400/248 |
| 5,247,314 | 9/1993 | Stephenson | 400/120.04 |
| 5,526,741 | 6/1996 | Gallagher et al. | 400/74 |
| 5,628,574 | 5/1997 | Crowley | 400/74 |

FOREIGN PATENT DOCUMENTS

| | | | |
|---|---|---|---|
| 61-132379 | 6/1986 | Japan | 400/708 |
| 61-134274 | 6/1986 | Japan . | |
| 5-201043 | 8/1993 | Japan | 400/708 |

*Primary Examiner*—John Hilten

[57] ABSTRACT

In a single-pass, multi-head thermal printer, wherein a recording material is transported along a transport path, a mark sensor is disposed in proximity to each of a plurality of thermal heads. The sensors detect positioning marks which are provided on the recording material at constant intervals in the transporting direction. Each time a positioning mark is detected, a timer circuit begins measuring the time that has passed since the last detection of a positioning mark. If the measured time reaches a predetermined jam detection time, an alarm or a warning display is given, and the recording material stops being transported.

17 Claims, 5 Drawing Sheets

FEED OUT SECTION
74
Y-RECORDING SECTION
63
M-RECORDING SECTION
64
C-RECORDING SECTION
65
55
SYSTEM CONTROLLER
JAM DETECTION SIGNAL
MARK DETECTION SIGNAL
56
TJ
COINCIDENCE CKT
68
LT
TIMER CKT
67
MARK PROCESSING CKT
53
MOTOR CONTROLLER
70
COUNTER
72
DRIVER
71
M
23
60
SENSOR DRIVE-READ CKT
51
M-TRANSPORTING SECTION
61
M-JAM DETECTING SECTION
57
C-TRANSPORTING SECTION
62
C-JAM DETECTING SECTION
58
10
36
11
20b
26
17
14
20a
20

THERMAL PRINTER WITH JAM DETECTION DEVICE

BACKGROUND OF THE INVENTION

1. Field of the Invention

The present invention relates to a thermal printer with a jam detection device which detects a jam of a recording material in a transport path through the thermal printer.

2. Background Arts

There are many types of color thermal printers, which are mainly classified into thermal transfer type such as ink transfer type and wax transfer type, and direct printing type using a thermosensitive recording material. A color thermosensitive recording material includes at least cyan, magenta and yellow recording layers which have different thermal sensitivities and develop respective colors in different heat energy ranges.

There is a single-pass multi-head type color thermal printer which has a plurality of, e.g. three thermal heads for the three colors, and in which a recording material, e.g. the color thermosensitive material, is passed through the thermal heads a single time to sequentially record three color frames of a full-color image, for example, as disclosed in JPA 5-201043 and JPB 6-96338. Platen rollers are disposed in opposition to the thermal heads to press the recording material onto the thermal heads while a designated recording area of the recording material passes through them.

The single-pass multi-head type has an advantage in that it takes a shorter time to print a full-color image, compared with a single-head three-pass type color thermal printer in which a sheet of color recording material is passed through a single thermal head three times to record a full-color image. However, as the transport path is elongated with the plural number of thermal heads, it is necessary to provide a plurality of pairs of rollers for transporting the recording material through the path. Because the transporting speeds of the roller pairs can change from one another, the recording material can get loose or tensed between the roller pairs. If the recording material is too loose, it jams between the roller pair. The greater the number of the roller pairs, the more the recording material is apt to jam.

SUMMARY OF THE INVENTION

A prime object of the present invention is to provide a jam detection device for a thermal printer, particularly for a single-pass multi-head type color thermal printer, which can reliably detect a jam of the recording material with a simple configuration.

To achieve the above and other objects in a thermal printer wherein an image is recorded on a recording material while the recording material is being transported along a transport path, the present invention provides marks on the recording material at a constant interval in the transporting direction, a mark sensor for generating a mark detection signal each time the mark sensor detects the mark, means for measuring time intervals between the mark detection signals, and means for comparing the measured time intervals with a predetermined jam detection time to detect a jam of the recording material when the measured time interval reaches the jam detection time.

According to a preferred embodiment of the present invention, the thermal printer is further provided with means for controlling transportation of the recording material based on the mark detection signals detected through the mark sensor. For a color thermal printer which records at least three color frames of a full-color image in a frame sequential fashion on a recording area of a recording material to print the full-color image, the mark detection signals are preferably utilized for determining a start position of each recording area and thus for color registration.

The jam detection time may be determined based on a normal time interval between the mark detection signals that is calculated from the constant interval of the marks, a transporting speed of the recording material, and other additional factors, such as the time of driving cycle of the mark sensor.

In a single-pass multi-head type color thermal printer, it is preferable to provide a mark sensor in association with each thermal head, and to determine a jam detection time for each mark sensor.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The above and other objects and advantages of the present invention will become apparent from the following detailed description of the preferred embodiments when read in connection with the accompanying drawings, which are given by way of illustration only and thus are not limitative of the present invention, wherein like reference numerals designate like or corresponding parts throughout the several views, and wherein.

DETAILED DESCRIPTION OF THE PREFERRED EMBODIMENT

Figure 1:
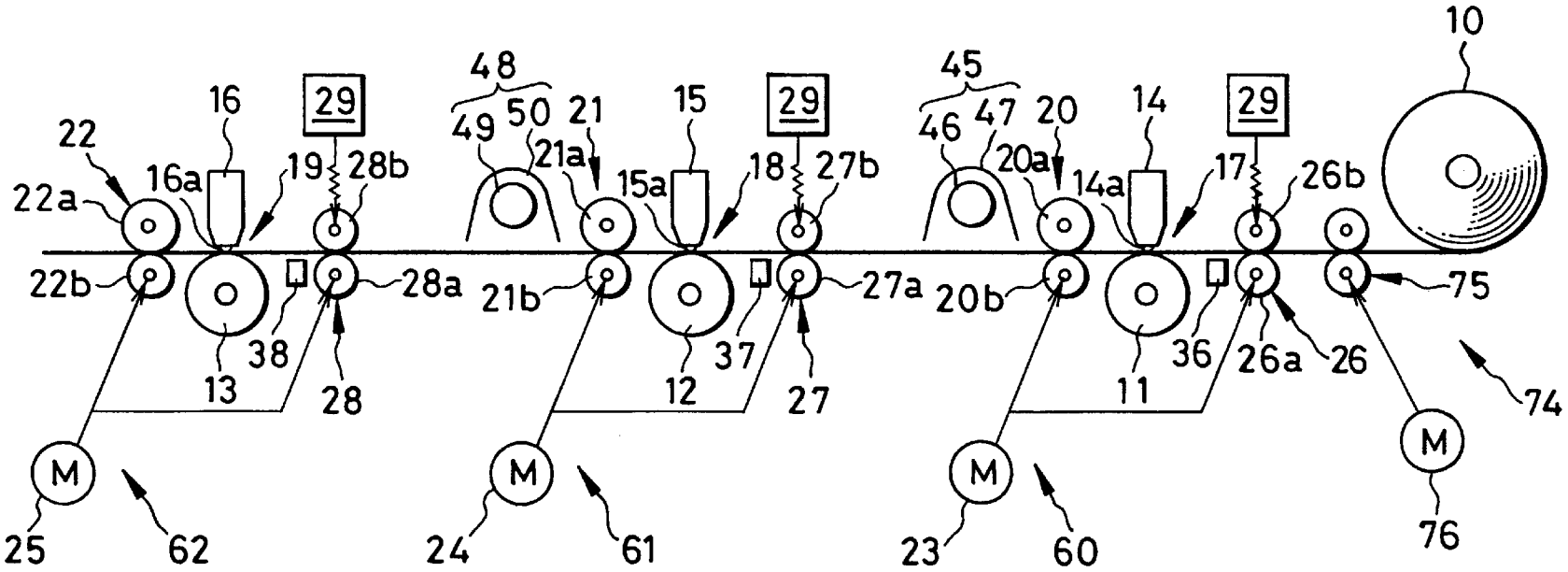
FIG. 1 is a schematic diagram illustrating a single-pass three-head type direct color thermal printer according to an embodiment of the present invention.

In the thermal printer of FIG. 1, three platen rollers 11, 12 and 13 are disposed at appropriate intervals along a transport path of a color thermosensitive recording material 10, hereinafter referred to as a recording material 10. In opposition to the platen rollers 11 to 13, a yellow thermal head 14, a magenta thermal head 15 and a cyan thermal head 16 are disposed to provide a yellow printing stage 17, a magenta printing stage 18 and a cyan printing stage 19, respectively. Behind and proximate the respective platen rollers 11 to 13 with respect to a transporting direction of the recording material 10, there are disposed feed roller pairs 20, 21 and 22. Each pair consists of a pinch roller 20*a*, 21*a* or 22*a* and a capstan roller 20*b*, 21*b* and 22*b*. The capstan rollers 20*b*, 21*b* and 22*b* are each individually driven to rotate by pulse motors 23, 24 and 25, to withdraw the recording material 10 from a not-shown roll and feed it sequentially to the thermal heads 14 to 16.

Figure 2:
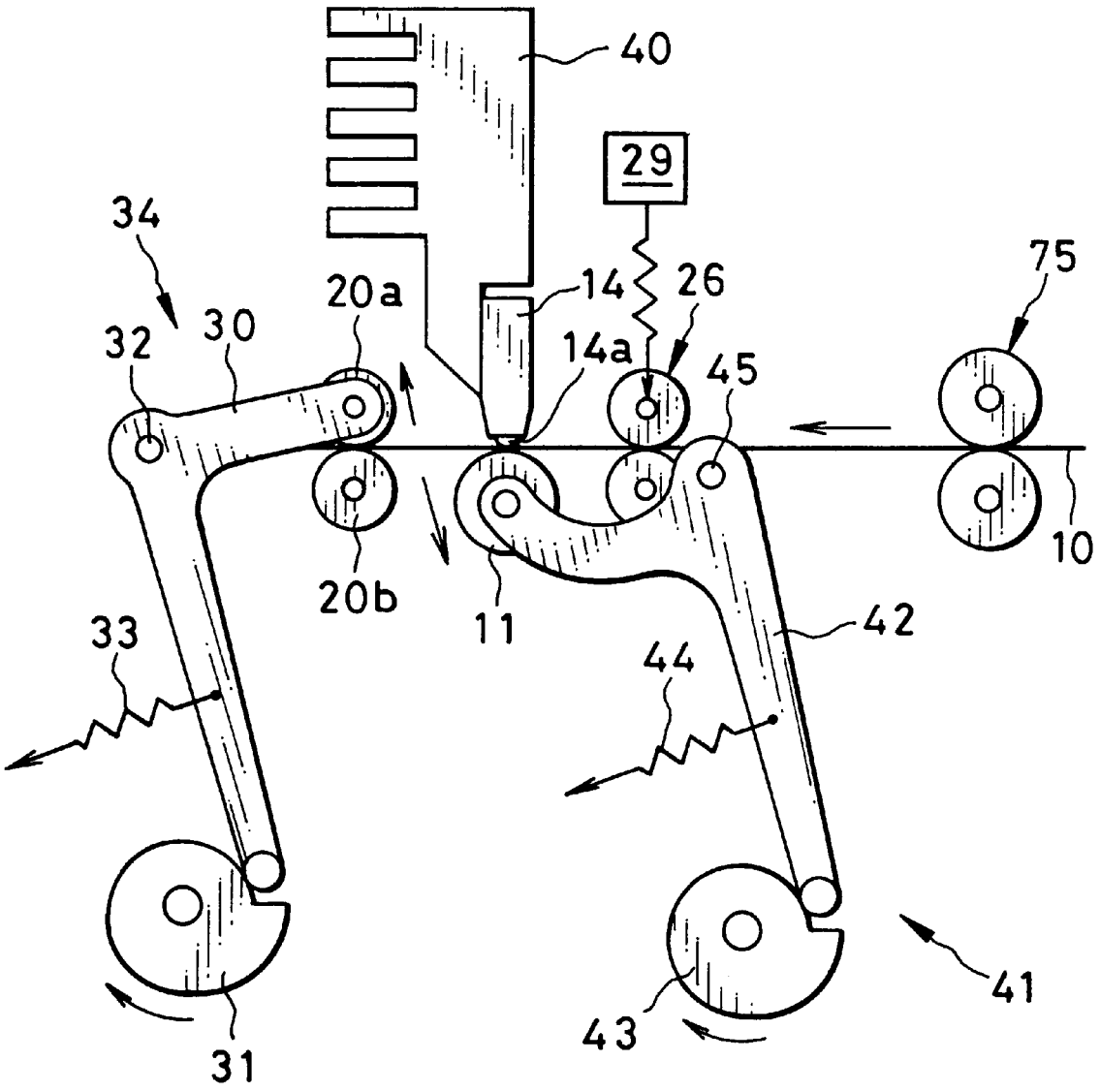
FIG. 2 is an enlarged explanatory diagram illustrating a yellow printing stage of the printer shown in FIG. 1.

The capstan roller 20*b* is mounted horizontally to a not-shown fixed frame, while the pinch roller 20*a* is mounted horizontally to a swinging arm 30, as shown in FIG. 2. The swinging arm 30 can swing about an axle 32 through a given angle in cooperation with a cam 31. The swinging arm 30 is urged by a coil spring 33 to press the pinch roller 20*a* against the capstan roller 20*b*. These elements 30 to 33 constitute a roller shift mechanism 34. In this way, the pinch roller 20*a* is in tight contact with the capstan roller 20*b* while the cam 31 is in a position shown in FIG. 2. To pass a leading edge of the recording material 10, the cam 31 is rotated by a given angle to remove the pinch roller 20*a* from the capstan roller 20*b*. The other feed roller pairs 21 and 22 have the same roller shifting mechanism 34 as the feed roller pair 20. The roller shifting mechanisms 34 may have another construction if only they can shift the pinch rollers 20*a*, 21*a*, and 22*a*. For example, the roller shifting mechanism may be comprised of a cam or a solenoid that directly couples to the shaft of the pinch roller.

Near before the respective platen rollers 11, 12 and 13 in the transporting direction of the recording material 10, there are guide roller pairs 26, 27 and 28. Each of the guide roller pairs 26 to 28 is constituted of a drive roller 26*a*, 27*a* or 28*a* and a pinch roller 26*b*, 27*b* and 28*b*. Roller shifting mechanisms 29 are coupled to the pinch rollers 26*b* to 28*b* to move them each individually between a guide position gently pressed onto the drive rollers 26*a* to 28*a*, and a retracted position away from the drive rollers 26*a* to 28*a*. The drive rollers 26*a* to 28*a* are driven by the pulse motors 23 to 25 in synchronism with the capstan rollers 20*b* to 22*b*, respectively.

Closely behind the guide roller pairs 26 to 28 in the transporting direction, mark sensors 36, 37 and 38 are disposed. Each mark sensor 36, 37 or 38 is a reflective sensor having a light projector and a light receptor, to detect positioning marks 39.

Figure 3:
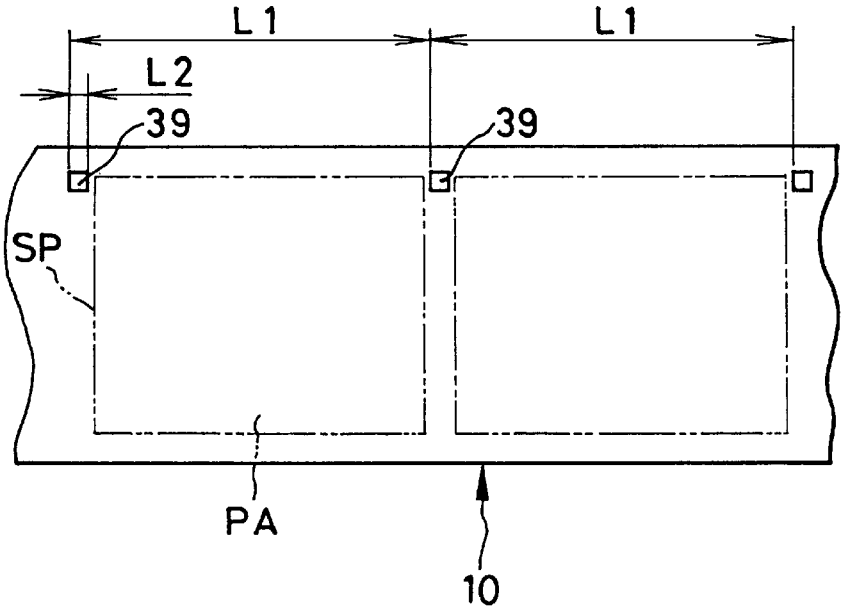
FIG. 3 is an explanatory diagram illustrating positioning marks on a recording material.

The positioning marks 39 are printed on the opposite surface of the recording material 10 from the recording surface on which thermosensitive recording layers are formed. The positioning marks 39 are formed at regular intervals L1, i.e. one for one recording area PA in margins out of the recording areas PA of the recording material 10, as shown in FIG. 3. However, it is possible to provide positioning marks at smaller intervals such that a plurality of marks are allocated to one recording area PA. Then, it becomes possible to change the size of the recording areas PA while determining the start position of each recording area based on the number of the positioning marks.

In the yellow printing stage 17, drive pulses applied to the pulse motor 23 start to be counted from the time of detection of each positioning mark 39 by the mark sensor 36. Based on the count, the present position of the recording material 10 and thus a start position SP of each recording area PA can be determined. The detection signal from the mark sensor 36 is also used for controlling driving the thermal head 14. In the same way, the mark sensors 37 and 38 determine the start positions SP of the recording areas PA in the magenta and the cyan printing stages 18 and 19, respectively. Thus, registration of the three color frames is automatically accomplished. The positioning marks 39 are also utilized for detecting jamming of the recording material as will be described in detail later.

The thermal heads 14 to 16 each have a respective heating element array 14*a*, 15*a* and 16*a* each, which consists of a great number of heating elements and extends in a main scanning direction that is an axial direction of the platen rollers 11 to 13. As shown in FIG. 2, the thermal head 14 has a heat radiator or cooling fin 40. The thermal heads 15 and 16 have the same construction as the thermal head 14.

The platen roller 11 is coupled to a roller shifting mechanism 41, which is constituted of a swinging arm 42, a cam 43, and a coil spring 44, as shown in FIG. 2. The swinging arm 42 can swing about an axle 45 through a given angle in cooperation with the cam 43. The swinging arm 42 is urged by the coil spring 44 to press the platen roller 11 against the heating element array 14*a* of the thermal head 14. The platen roller 11 is in contact with the heating element array 14*a* while the cam 43 is in a position shown in FIG. 2. To pass a leading edge of the recording material 10, or at the trailing end of each recording area, the cam 43 is rotated by a given angle to release contact between the platen roller 11 and the thermal head 14. The other platen rollers 12 and 13 are coupled to the same roller shifting mechanisms as the roller shifting mechanism 41.

The cams 31 and 43, and not shown cams for the magenta and cyan printing stages 18 and 19 are controlled with respect to the detection signal from the mark sensors 36 to 38.

As shown in FIG. 1, an optical fixing device 45 for yellow is disposed between the yellow thermal head 14 and the magenta thermal head 15. The optical fixing device 45 consists of a lamp 46 radiating ultraviolet rays having an emission peak at 420 nm, and a reflector 47. An optical fixing device 48 for magenta is disposed between the magenta thermal head 15 and the cyan thermal head 16. The optical fixing device 48 consists of a lamp 49 radiating near-ultraviolet rays having an emission peak at 365 nm, and a reflector 50.

Figure 4:
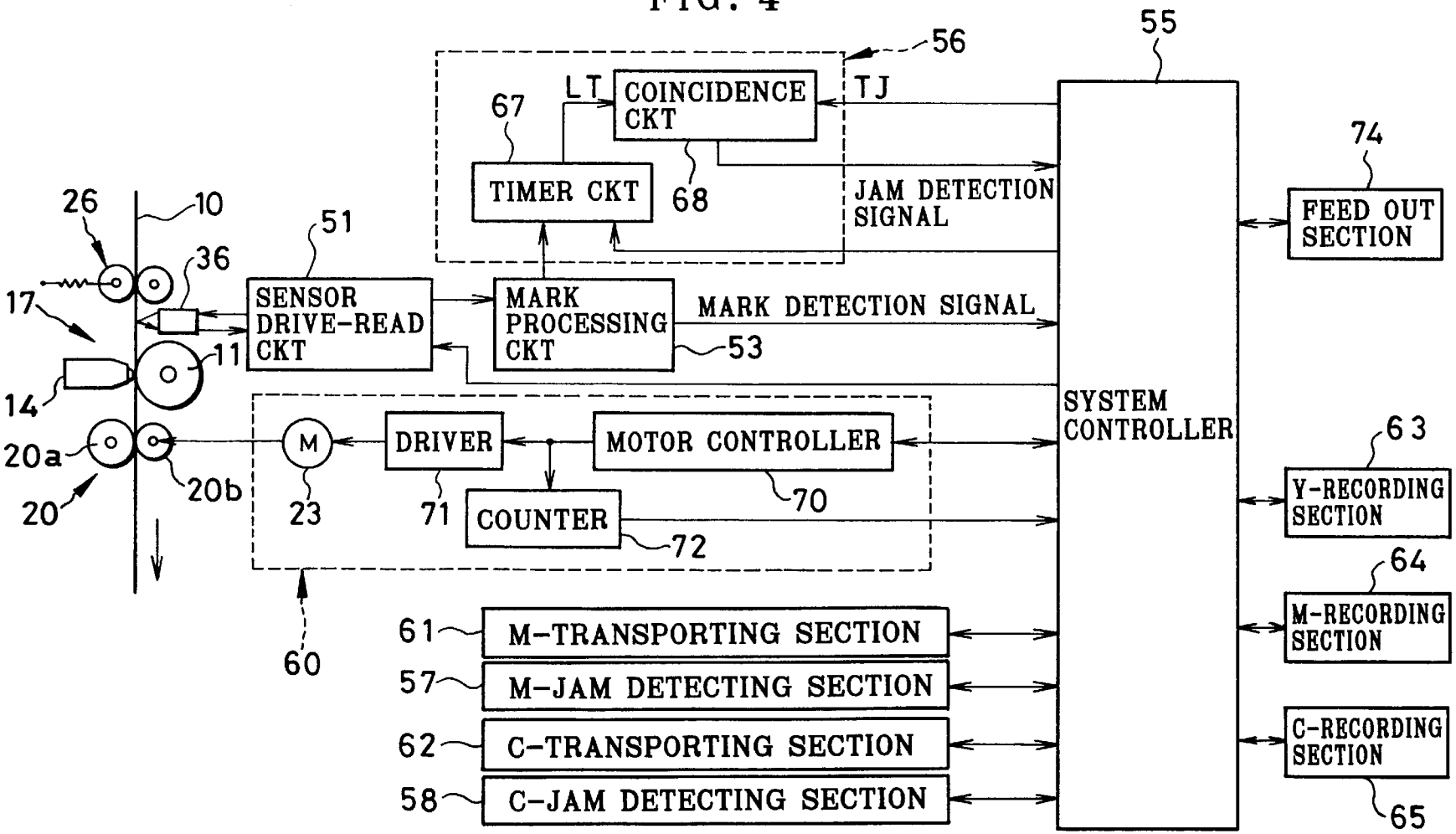
FIG. 4 is a block diagram of the circuitry of the printer shown in FIG. 1.

Referring to FIG. 4 showing the circuitry of the thermal printer, the output signal from the mark sensor 36 is sent to a mark processing circuit 53 through a sensor drive-read circuit 51. The mark processing circuit 53 generates a mark detection signal from the output signal from the mark sensor 36, and sends it to a system controller 55. The sensor drive-read circuit 51 drives the light projector of the mark sensor 36 in a constant cycle, and amplifies an output signal from the light receptor of the mark sensor 36 before sending it to the mark processing circuit 53. The driving cycle of the mark sensor 36 is determined such that the light projector projects light toward the recording material 10 at least once while each individual positioning mark 39 passes the mark sensor 36 one after another. Therefore, the driving interval depends upon a length L2 of the positioning mark 39 in the transporting direction of the recording material 10 (see FIG. 3) and the transporting speed of the recording material 10. In the same way as for the mark sensor 36 of the yellow printing stage 17, the mark sensors 37 and 38 of the magenta and cyan printing stages 18 and 19 are driven in the constant cycle, and the detection signals from the mark sensors 37 and 38 are sent to the system controller 55.

The system controller 55 sequentially controls jam detecting sections 56, 57 and 58, transporting sections 60, 61 and 62, and recording sections 63, 64 and 65 for yellow, magenta and cyan, respectively. The jam detecting section 56 for yellow, the transport section 60 for yellow, and the recording 63 section for yellow are referred to as a Y-jam detecting section 56, a Y-transporting section 60, and a Y-recording section 63, respectively. The jam detecting, transport and recording sections 57, 61 and 64 for magenta are referred to as a M-jam detecting section 57, a M-transporting section 61, and a M-recording section 64, respectively. The jam detecting, transport and recording sections 58, 62 and 65 for cyan are referred to as a C-jam detecting section 58, a C-transporting section 62, and a C-recording section 65, respectively. Since these elements operates in the same way for each color, the following description will be related to the yellow printing stage 17 as a representative.

The system controller 55 controls start and stop of the pulse motor 23 through a motor controller 70 of the Y-transport section 60. The motor controller 70 outputs motor drive pulses to a motor driver 71, to thereby rotate the pulse motor 25 at a designated speed. A counter 72 starts counting the motor drive pulses in response to the mark detection signal from the system controller 55, and outputs the count to the system controller 55. Based on the count of the counter 72, the system controller 55 determines the start position SP of each recording area PA, and also determines when to press the recording material 10 onto the heating element array 14*a,* and when to start driving the heating element array 14*a.*

The mark processing circuit 53 also sends the mark detection signal to a timer circuit 67 of the Y-jam detecting section 56. The timer circuit 67 counts clock pulses from a not-shown clock generator, and the count is reset to zero each time the timer circuit 67 receives the mark detection signal, so that the count of the timer circuit 67 represents a time LT that has passed since the last detection of the positioning mark 39 by the mark sensor 36. The count of the timer circuit 67 is processed as time data LT to be sent to a coincidence circuit 68.

The coincidence circuit 68 is preset with a jam detection time TJ, so as to compare the time LT with the jam detection time TJ. When the time LT reaches the jam detection time TJ, the coincidence circuit 68 outputs a jam detection signal or time out signal to the system controller 55. Then, the system controller 55 stops transporting the recording material 10 and driving the thermal head 14, and outputs a timer stop signal to the timer circuit 67. Simultaneously, the system controller 55 gives an alarm and/or displays a warning. Because the jam detection is carried out in the respective printing stages, it is possible to indicate the printing stage where the recording material 10 has jammed.

The jam detection time TJ is determined as follows:

Assuming that the positioning marks 39 are arranged at the interval L1, that the pulse rate of the drive pulses to the pulse motor 23 is P1 (pps), and that the capstan roller 20*b* feeds the recording material 10 by a quantity Q1 (mm) per drive pulse, the positioning marks 39 normally pass the mark sensor 36 at a time interval T1 (sec.)=L1/(P1×Q1). Assuming that "A" (sec.) represents one cycle time of driving the mark sensor 36, the jam detection time TJ (sec.) may be defined as TJ=T1+A. It is possible to add a constant B (sec.) to the jam detection time TJ, i.e. TJ=T1+A+B, so as to take slight fluctuation in the feeding quantity into consideration.

The system controller 55 controls each of the thermal heads 14 to 16 through the Y-, M- and C-recording sections 63 to 65 in cooperation with the Y-, M- and C-transporting sections 60 to 62, respectively. The recording sections 63 to 65 perform bias heating and then image heating line after line by each color, while the recording material 10 is transported in a subscanning direction perpendicular to the main scanning direction. The recording sections 63 to 65 may have those constructions disclosed in JPA 7-137320 or JPA 7-144428.

Now the operation of the thermal printer as set forth above will be described.

When the a print start switch (not shown) is turned on, the system controller 55 turns the optical fixing devices 45 and 48 on, and activates a feed out section 74 to feed out the recording material 10 from a roll. At that time, the guide roller pairs 26 to 28, the platen rollers 11 to 13 and the feed roller pairs 20 to 22 are in their released or retracted positions.

The recording material 10 is then fed through a pair of feed rollers 75 toward the platen roller 11. When the mark sensor 36 detects the leading edge of the recording material 10, the system controller 55 starts counting drive pulses to a pulse motor 76 which drives the feed rollers 75. Based on the number of drive pulses to the pulse motor 76, the system controller 55 moves the pinch rollers 26*b* to 28*b* and 20*a* to 22*a* of the guide roller pairs 26 to 28 and of the feed roller pairs 20 to 22 sequentially down to nip the recording material 10. Also, the system controller 55 starts supplying the motor drive pulses to the pulse motors 23 to 25, each at an appropriate timing.

The counter 72 starts counting the motor drive pulses to the pulse motor 23 in response to a mark detection signal from the mark sensor 36. Based on the count of the counter 72, the system controller 55 determines the start position SP of each recording area PA, and brings the recording material 10 into contact with the heating element array 14*a*. Under the control of the system controller 55, the Y-recording section 63 performs recording of a yellow frame line by line in each recording area PA.

While the thermal head 14 conducts yellow frame recording, the feed roller pair 20 feeds the recording material 10 toward the next printing stage 18. While the recording material 10 is being moved under the optical fixing device 45, the yellow recording layer is fixed by the ultraviolet rays of 420 nm. Since the recording material 10 is continuously fed to the printing stages 17 to 19 in the single-pass type printer, the thermal head 14 after terminating the yellow frame recording starts recording the next yellow frame of the next full-color image when the start position SP of the next recording area PA of the recording material 10 is moved in under the heating element array 14*a*.

In the same way as for the above yellow printing stage 17, the system controller 55 controls the M-transporting section 61 and the M-recording section 64 based on the mark detection signal from the mark sensor 37, to conduct recording a magenta frame line by line in the magenta printing stage 18. The magenta recording layer is thereafter fixed by the ultraviolet rays of about 365 nm from the optical fixing device 48. The system controller 55 controls the C-transporting section 62 and the C-recording section 65 with reference to the mark detection signals from the mark sensor 38, such that a cyan frame is recorded line by line to the cyan recording layer in the cyan printing stage 19.

The timer circuit 67 starts counting up the clock pulses from zero in response to the mark detection signal from the mark processing circuit 53. The time LT after the latest detection of the positioning mark 39, which is represented by the count of the timer circuit 67, is compared with the jam detection time TJ in the coincidence circuit 68. If the time LT reaches the jam detection time TJ, the coincidence circuit 68 outputs a jam detection signal to the system controller 55. Then, the system controller 55 stops transporting the recording material 10 and driving the thermal head 14, and gives an alarm and/or displays a warning. The system controller 55 also outputs a timer stop signal to the timer circuit 67.

When a print start signal is entered again after repairing the jam, the system controller 55 outputs a timer start signal to the timer circuit 67. Comparison of the time LT with the jam detection time TJ is effective to detect a jam of the leading edge of the recording material 10.

In a case where the pulse rate of the drive pulses to the pulse motors 23 to 25 is changed to provide a slack portion in the recording material 10 between adjacent two of the thermal heads 14 to 16, so as to absorb fluctuation in transporting speed through one of the two thermal heads, it is preferable to calculate the jam detection time as a variable TJ' for each printing stage based on the present pulse rate P1' of the associated pulse motor each time the pulse rate P1 is revised. That is, $TJ'=\{L1/(P1'\times Q1)\}+A$.

Figure 5:
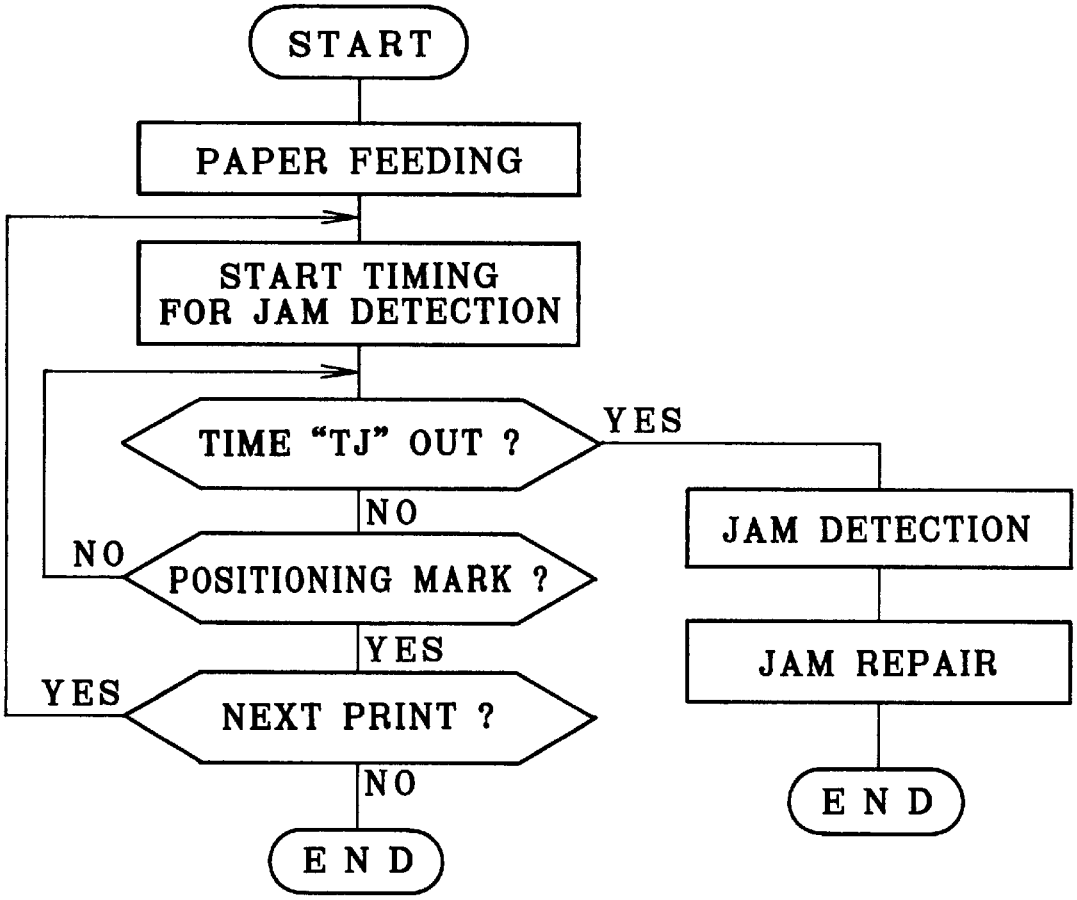
FIG. 5 is a flow chart illustrating a sequence of jam detection according to another embodiment of the present invention.

In the above embodiment, the jam detecting sections 56 to 58 are constituted of hardware elements such as the timer circuit 67 and the coincidence circuit 68. However, jam detection can be executed as a software process using a program sequence as shown in FIG. 5. It is also possible to compare the count of the timer circuit directly with data of the number of clock pulses that corresponds to the jam detection time TJ.

Although the positioning marks are assumed to be formed on the reverse side of the recording material 10 in the embodiment shown in the drawings, it is possible to provide the positioning marks on the obverse side on which the thermal heads 14 to 16 are contacted. The positioning marks may be provided previously by another printing process, or immediately before the color image printing by use of a specific thermal head. It is alternatively possible to provide holes or notches as positioning marks. In that case, another type of mark sensors suitable for detecting holes or notches should be used. The positioning marks may be utilized for cutting the continuous recording material 10 into individual sheets after the image printing.

Although the present invention has been described with respect to the direct color printer, the present invention is applicable to any kind of thermal printer including those having a single thermal head. The present invention is of course applicable to thermal ink transfer type color printers, wherein yellow, magenta and cyan ink ribbons are inserted in between heating element arrays of thermal heads and an appropriate recording material, to thermally transfer the yellow, magenta and cyan inks to the recording material. The present invention is applicable to thermal wax transfer type color printers as well. It is possible to provide a fourth printing stage to use a black ink ribbon in addition to the three color ink ribbons.

In the above described embodiments, the thermal heads are stationary mounted, and the platen rollers are moved up and down, so that the positions of the heating element arrays may not deviate relative to the recording material. By positioning the heating element arrays of the respective thermal heads in the same plane, as shown in FIG. 1, the distortion of the recording material relative to the heating elements is minimized, so that the accurate color registration is achieved. But it is possible to move the thermal heads up and down. The platen rollers may be replaced by platen plates. The recording material may be fed as a sheet having a limited length.

Figure 6:
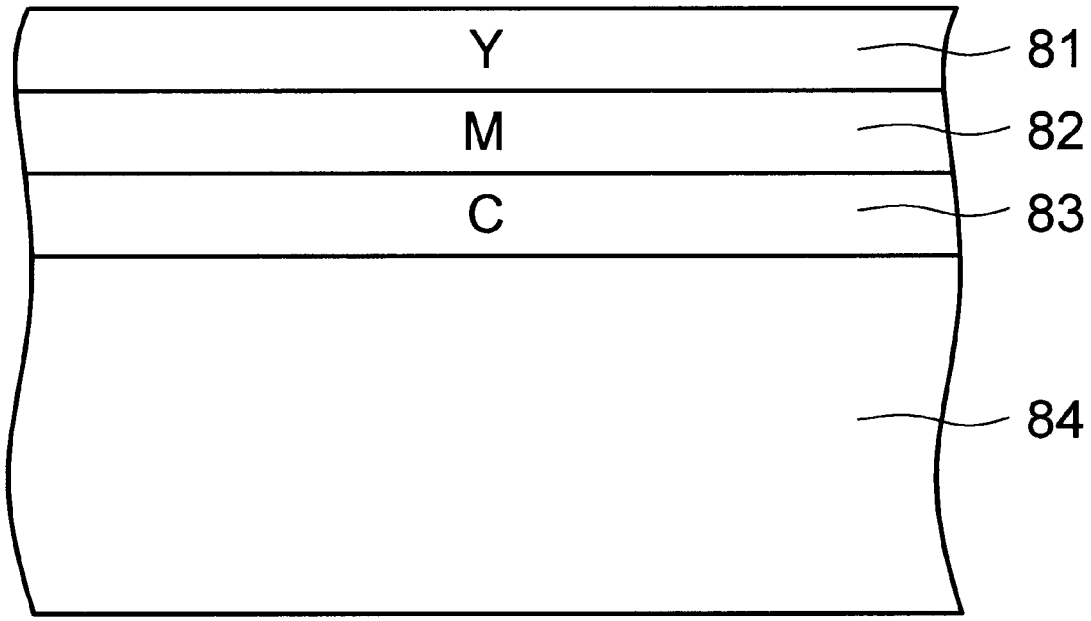
FIG. 6 illustrates an example of a direct coloring thermosensitive recording medium of an embodiment of the present invention.

Moreover, in the above described embodiments, a multilayer thermosensitive recording material as illustrated in FIG. 6 may be used. As illustrated, the recording material includes an outermost yellow layer 81 followed sequentially by a magenta layer 82, a cyan layer 83 and a base 84. In this particular embodiment, the outermost yellow layer 81 has a greatest respective heat sensitivity, the magenta layer 82 has a second greatest respective heat sensitivity, and the cyan layer 83 a smallest respective heat sensitivity. The layers and colors thereof however should not be limited as illustrated in FIG. 6. Moreover, the color thermosensitive recording material may have a black recording layer and/or a specific recording layer for a particular color such as a flesh color, in addition to the three color recording layers.

It is possible to orient the thermal heads 14 to 16 substantially parallel to the recording material 10, though the thermal heads 14 to 16 are oriented substantially vertical to the recording material 10.

Thus, the present invention should not be limited to the above described embodiments but, on the contrary, various modifications may be possible to those skilled in the art. Such modification are not to be regarded as a departure from the spirit and scope of the invention, and all such modifications as would be obvious to one skilled in the art are intended to be included within the scope of the claims attached hereto.

What is claimed is:

1. A color thermal printer comprising:

a plurality of thermal heads arranged in series along a transport path of a recording material, each of the plurality of thermal heads recording a different color frame of a full-color image in a recording area of the recording material to print the full-color image during a single advancement of the recording material in a transporting direction through the transport path;

a plurality of mark sensors, each being disposed in association with one of the plurality of thermal heads, for generating a mark detection signal each time the mark sensor detects a mark, a plurality of marks being provided on the recording material at constant intervals in a transporting direction of the recording material;

means for measuring a time interval between generation of successive mark detection signals from each of the plurality of mark sensors; and means for comparing the time interval with a jam detection time, predetermined for each mark sensor, and detecting jamming of the recording material when the measured time interval equals the predetermined jam detection time.

2. The thermal printer according to claim 1, wherein the mark detection signals are utilized to determine a start position of each recording area.

3. The color thermal printer according to claim 2, further comprising driving means for driving transporting mechanisms with reference to the mark detection signals, to transport the recording material at an appropriate speed through each of the plurality of thermal heads, wherein the jam detection time is predetermined for each mark sensor based on a time interval between mark detection signals defined by an interval length between successive marks, the transporting speed of the recording material through the associated thermal head, and a cycle time of driving the respective mark sensor.

4. The color thermal printer as claimed in claim 2, wherein the plurality of thermal heads are sequentially brought into contact with the recording material prior to starting recording of the respective color frames, the color thermal printer further comprising means for controlling the timing of contact between the respective thermal heads and the recording material with reference to the respective mark detection signals.

5. The color thermal printer as claimed in claim 1, wherein the recording material is a color thermosensitive recording material having at least three color thermosensitive recording layers, the color thermosensitive recording layers having heat sensitivities decreasing with distance thereof from an obverse surface of the color thermosensitive recording material, the color thermal printer further comprising:

a first optical fixing device disposed behind the one of the plurality of thermal heads furthest upstream in the transporting direction, the first optical fixing device optically fixing the most obverse color thermosensitive recording layer after the furthest upstream thermal head performs recording to the most obverse color thermosensitive recording layer; and a second optical fixing device disposed behind the one of the plurality of thermal heads next furthest upstream in the transporting direction, the second optical fixing device optically fixing the second obverse color thermosensitive recording layer after the next furthest upstream thermal head performs recording to the next most obverse color thermosensitive recording layer.

6. The color thermal printer of claim 1, wherein the recording material is a color thermosensitive recording medium comprising plural recording layers arranged sequentially on each other from an uppermost printing surface of the color thermosensitive recording medium, each of the plural recording layers having a different respective thermosensitivity.

7. The color thermal printer of claim 6, wherein the plural recording layers have respective thermal sensitivities which decrease with respect to distance from the uppermost printing surface of the color thermosensitive recording medium.

8. The color thermal printer of claim 1, wherein the recording material comprises a continuous recording medium.

9. A color thermal printing method comprising the steps of:

a) transporting a recording medium along a transport path;

b) detecting a plurality of marks on the recording medium from plural locations along the transport path, the plurality of marks being disposed at predetermined intervals along a transport direction of the recording medium;

c) recording a full-color image on the recording medium during a single pass of the recording medium through the transport path;

d) measuring time intervals between successive detections of the plurality of marks at each of the plural locations;

e) comparing the time intervals with respective jam detection times for each of the plural locations; and f) designating a jam condition when a time interval is determined in said step e) as equal to a respective jam detection time.

10. The color thermal printing method of claim 9, wherein said step c) comprises recording each color of the full-color image with a respective different thermal head.

11. The color thermal printing method of claim 10, wherein the plurality of marks are detected near each respective different thermal head in said step b), said step a) comprising transporting the recording medium at an appropriate transporting speed past the respective different thermal heads in accordance with the plurality of marks detected in said step b).

12. The color thermal printing method of claim 11, wherein the jam detection time is respectively predetermined for each of the plural locations based on a time interval between successive detections of the plurality of marks defined by an interval length between successive marks, the transporting speed of the recording medium past respective thermal heads and a cycle time of detection at respective locations.

13. The color thermal printing method of claim 11, wherein said step c) comprises sequentially contacting the respective different thermal heads with the recording medium prior to starting recording of a respective color of the full-color image in accordance with detection of the plurality of marks near respective thermal heads.

14. The color thermal printing method of claim 9, wherein said step c) comprises recording the full-color image on a color thermosensitive recording medium comprising plural recording layers each having a different respective thermal sensitivity.

15. The color thermal printing method of claim 14, wherein the plural recording layers have respective thermal sensitivities which decrease with respect to distance from an upper printing surface of the color thermosensitive recording medium.

16. The color thermal printing method of claim 9, wherein the recording medium has plural recording areas, said step c) comprises determining a start position of each recording area based on the plurality of marks detected in said step b).

17. The color thermal printing method of claim 9, wherein said step a) comprises transporting a continuous recording medium along the transport path.

* * * * *